US007614526B2

(12) United States Patent
Gaillen

(10) Patent No.: US 7,614,526 B2
(45) Date of Patent: Nov. 10, 2009

(54) AEROSOL CAN HOLDER

(75) Inventor: Walter Richard Gaillen, Raymond, NH (US)

(73) Assignee: Summit Packaging Systems, Inc, Manchester, NH (US)

( * ) Notice: Subject to any disclaimer, the term of this patent is extended or adjusted under 35 U.S.C. 154(b) by 533 days.

(21) Appl. No.: 11/488,349

(22) Filed: Jul. 18, 2006

(65) Prior Publication Data

US 2007/0017933 A1 Jan. 25, 2007

Related U.S. Application Data

(60) Provisional application No. 60/700,527, filed on Jul. 19, 2005.

(51) Int. Cl.
*B65D 88/54* (2006.01)

(52) U.S. Cl. ..... 222/162; 222/183; 239/333; 604/207; 604/216

(58) Field of Classification Search ..... 222/162, 222/160, 325, 153.11, 402.11, 402.21, 183, 222/321.1, 321.8; 128/200; 239/333; 604/211, 604/514, 207, 216
See application file for complete search history.

(56) References Cited

U.S. PATENT DOCUMENTS 2,673,008 A * 3/1954 Ryan ..... 222/162
2,904,223 A * 9/1959 Ryan ..... 222/162
3,302,834 A * 2/1967 Aalsop ..... 222/162
3,405,843 A * 10/1968 Watson, Jr. ..... 222/95
3,934,761 A 1/1976 Gentreau
4,067,482 A 1/1978 Vogel et al.
4,264,037 A 4/1981 Nozawa
4,264,038 A 4/1981 Nozawa
4,324,351 A 4/1982 Meshberg
4,402,430 A * 9/1983 Fox et al. ..... 222/183
4,416,399 A 11/1983 Parr et al.
4,678,106 A * 7/1987 Newell et al. ..... 222/162
4,771,769 A * 9/1988 Hegemann et al. ..... 128/200.22
5,031,800 A * 7/1991 Brunet ..... 222/153.06
5,086,377 A 2/1992 Roberts
5,249,713 A 10/1993 Reich et al.
5,348,193 A * 9/1994 Bruckner et al. ..... 222/175
5,366,118 A 11/1994 Ciammitti et al.
5,447,150 A * 9/1995 Bacon ..... 128/200.14
5,458,263 A 10/1995 Ciammitti et al.
5,511,540 A 4/1996 Bryant et al.
5,531,359 A 7/1996 Winner
5,570,871 A * 11/1996 Westerfeld ..... 254/29 A
5,624,055 A 4/1997 Clanet et al.
6,196,419 B1 3/2001 Haney et al.
6,199,726 B1 * 3/2001 Cardwell et al. ..... 222/402.11
6,305,580 B1 * 10/2001 Chen ..... 222/162
6,588,631 B2 7/2003 Sanchez
6,676,270 B2 1/2004 Kostal et al.

(Continued)

*Primary Examiner*—Kevin P Shaver
*Assistant Examiner*—Andrew P Bainbridge
(74) *Attorney, Agent, or Firm*—Daniels Patent Law PLLC; Scott A. Daniels

(57) ABSTRACT

A holder for an aerosol can is provided in which a pivotable trigger mechanism can actuate the aerosol can by inducing a compressive force on the lower end of the can. When inducing this compressive force, the pivotable trigger mechanism is at an angle with the holder wall. After dispersing the contents of the aerosol can, the pivotable trigger mechanism can then be rotated such that the trigger mechanism substantially covers an opening in the holder body.

18 Claims, 16 Drawing Sheets

U.S. PATENT DOCUMENTS 7,278,554 B2 * 10/2007 Armstrong ..... 222/325
2004/0011819 A1 * 1/2004 Jennings et al. ..... 222/162
2004/0188473 A1 9/2004 Groh et al.

* cited by examiner

AEROSOL CAN HOLDER

This application claims the benefit of U.S. Provisional Application Ser. No. 60/700,527 filed Jul. 19, 2005.

FIELD OF THE INVENTION

The present invention relates to a holder or container for a spray aerosol, and more particularly to a container or holder which can be reused once the aerosol can has been depleted of its internal contents. The holder or container includes a trigger mechanism for securing the aerosol can within the container and having a position for biasly actuating the aerosol can and another position for protecting the aerosol can from unwanted actuation.

BACKGROUND OF THE INVENTION

There are a variety of aerosol dispensers used in many application including perfume dispensing, air freshening, personal hygiene and even for dispensing chemical repellant as a personal defense device. Typically an aerosol can delivers a product in the liquid state in the form of fine droplets projected in suspension in a compressed vehicle gas. Liquid dispersions in a gas medium of this type are commonly used in the above noted functions for dispensing such cosmetic or personal hygiene or personal defense products.

The aerosol can itself contains the liquid and gaseous medium and has reinforced metal walls opening to the outside through a valve kept closed by a spring or by the pressure of the vehicle gas contained in the aerosol can. The valve includes a valve stem whereupon pressure exerted on the valve stem allows some of the gas contained in the aerosol can under pressure to escape through the valve stem and into the atmosphere or wherever the aerosol spray is directed. Such products are often referred to as aerosols or sprays.

In many applications the above described aerosol cans are inserted or held in a holder or container which are intended to facilitate the actuation of the aerosol can and dispensing of the aerosol spray. The known holders or containers for such aerosol cans are however typically unattractive and poorly functioning devices which are furthermore subject to risk of accidental opening of the valve, for instance, when carried in a handbag or placed in a pockets of the users. The known containers are generally a cylindrical shape having a valve head consisting of a push button connected with the valve stem and include an overcap or lock to cover the push button and stop inadvertent actuation when not in use. However, this is not particularly reliable and includes more pieces than is necessary. Furthermore many of the known devices are composed of numerous small parts which are difficult to manufacture and also to assemble thus increasing the cost and complexity of assembly and operation of such devices.

SUMMARY OF THE INVENTION

It is an object of the present invention to remedy the above noted shortcomings of the prior art containers and provide a container for packaging and actuating a liquid product aerosol can. The container is generally provided with a nozzle and is manufactured in a design so as to have a pleasing appearance while providing for a simple actuating mechanism for dispensing the spray therefrom.

It is a further object of the present invention to provide a container which can be reused by simply disassembling the container and removing the aerosol can therefrom, inserting a new aerosol can and re-assembling the container.

It is still a further object of the present invention to provide a container or holder for the aerosol can which comprises a trigger mechanism having an actuating position relative to the container for actuating the dispensing valve of the aerosol can and an inoperable position where the trigger is placed in a position relative to the which will not actuate the aerosol can valve.

BRIEF DESCRIPTION OF THE DRAWINGS

The invention will now be described, by way of example, with reference to the accompanying drawings in which.

DETAILED DESCRIPTION OF THE INVENTION

Figure 1:
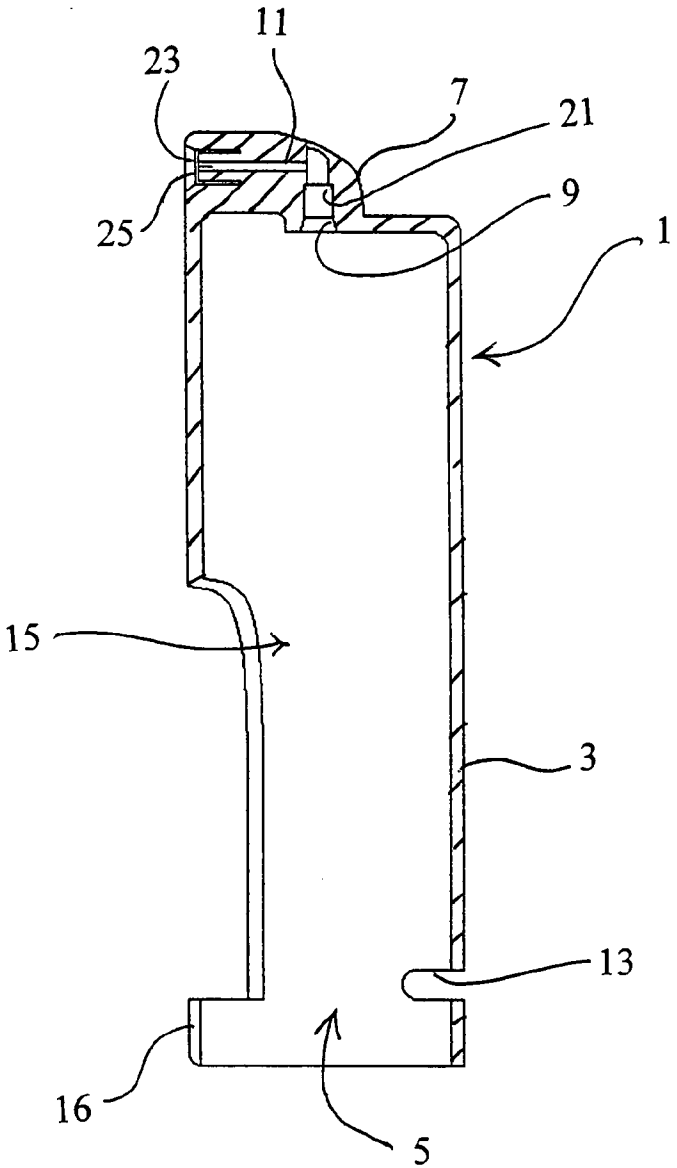
FIG. 1 is a cross-sectional view of the aerosol can holder of the present invention.

FIGS. 1-9 disclose a first embodiment of the present invention which is, in general, particularly similar to all the following embodiments with the exception of particular details and minor variations and various embodiments to be discussed. Observing FIG. 1, an aerosol can holder 1 is defined by a sidewall 3 having a generally open bottom end 5 and a substantially closed top end 7 except for the valve stem receiver 9 and product passage 11 which permits the passage and ejection of the pressurized aerosol product from the aerosol can.

The holder 1 is provided with a first opening 13 in the sidewall 3 and a second opening 15 in the sidewall 3 for receiving the trigger mechanism 17. The trigger mechanism 17, discussed in further detail below, engages, to some extent, both the first opening 13 and the second opening 15 in the sidewall 3 in order to perform its intended functions of maintaining the aerosol can in the holder 1 and actuate the valve stem of the aerosol can in order to release the contents of the aerosol can. A split 16 is provided in the bottom end of the holder extending from a lower most edge to the bottom edge of the opening 15 in order to provide some biasing expansion to the bottom end of the holder 1. As will be discussed in further detail below such a split 16 permits a certain flexibility in the sidewall 3 at the open bottom end 5 of the holder to facilitate the insertion and removal of the trigger 17.

The holder 1 is provided at a top portion 19 with a receiver 9 for receiving a valve stem (not shown) of the aerosol can. The receiver 9 extends vertically upwards to and includes a lip 21 for contacting a top edge of the valve stem of the aerosol can. The lip 21 engages the valve stem so that when the trigger mechanism 17 pushes the aerosol can upwards, as will be described in further detail below, the valve stem is pushed against the lip 21 thus releasing the aerosol product from the aerosol can into the product passage 11.

Figure 2:
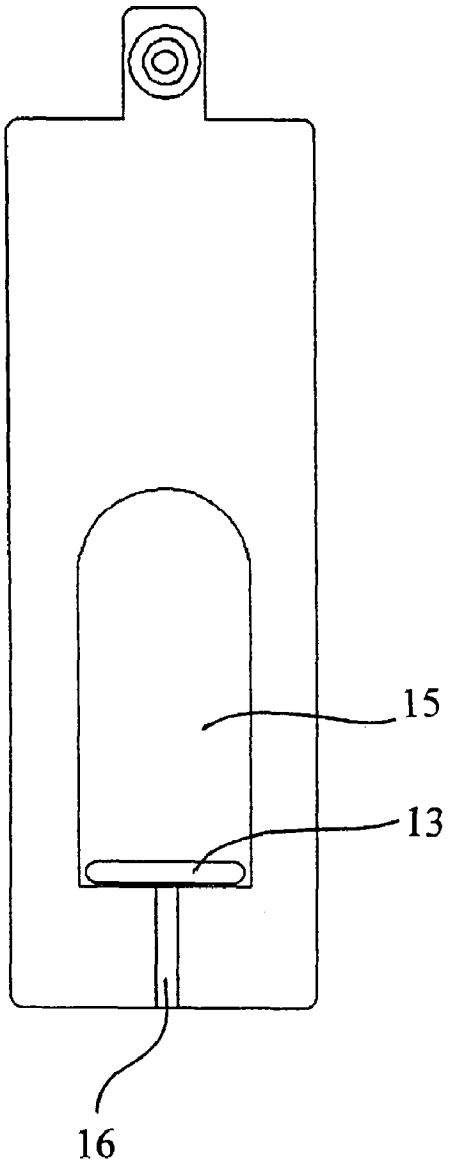
FIG. 2 is a front elevational view of the aerosol can holder of the present invention.
Figure 3:
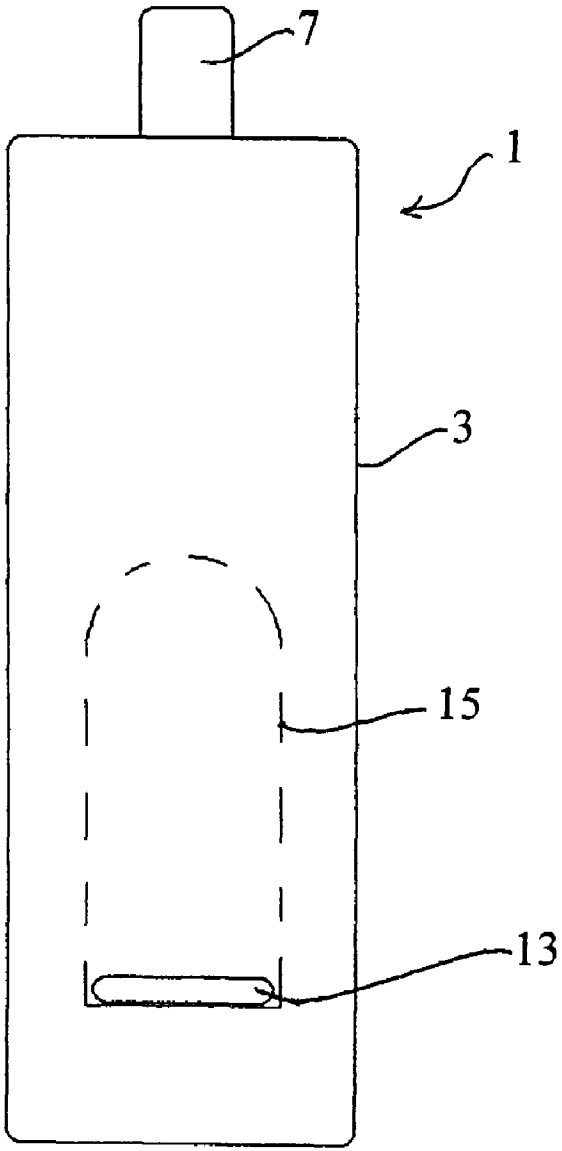
FIG. 3 is a rear elevational view of the aerosol can holder of the present invention.
Figure 4:
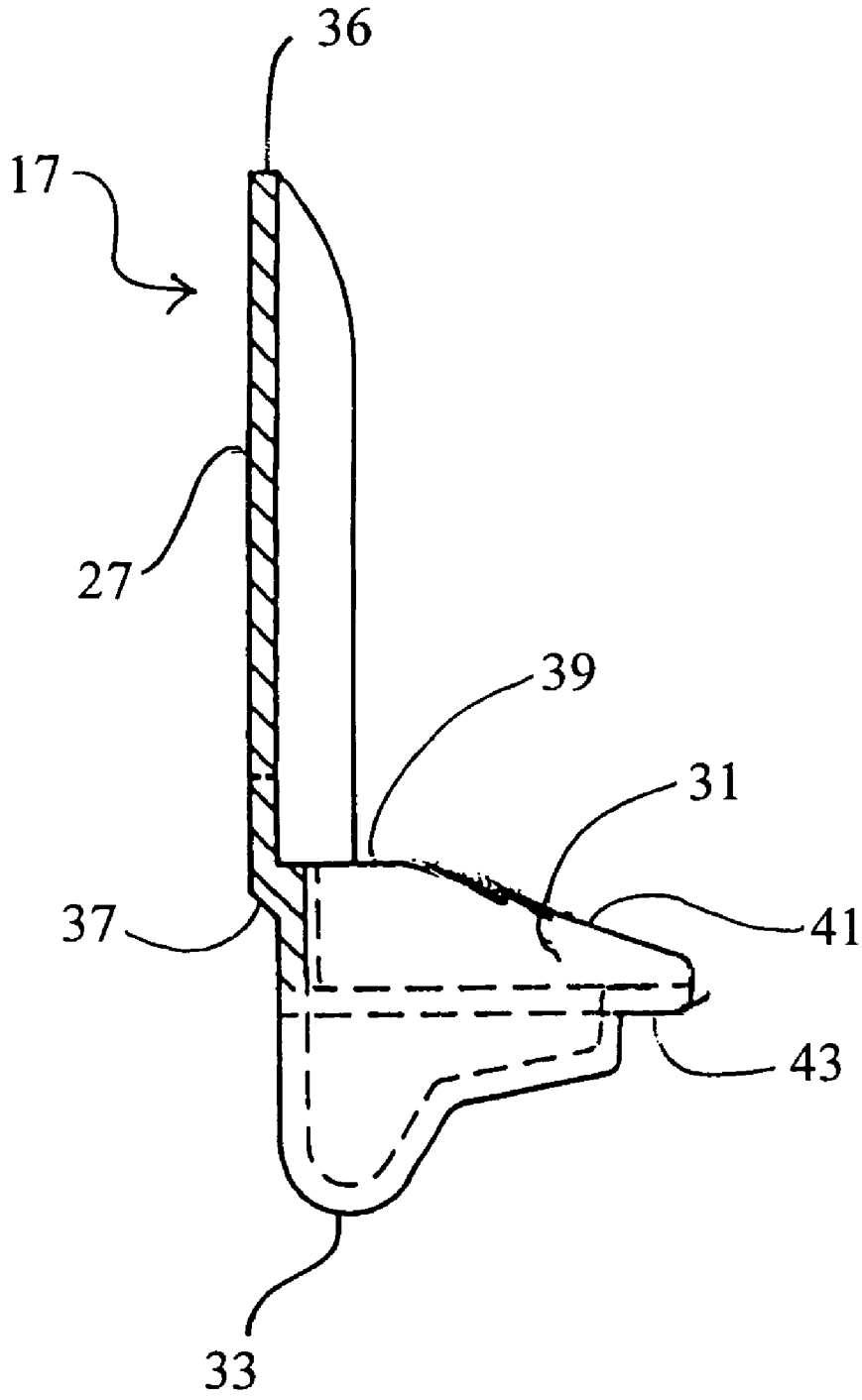
FIG. 4 is a cross-sectional view of the trigger mechanism of the aerosol can holder of the present invention.

The product passage 11 communicates with the outside atmosphere through a product outlet 23 generally located at the end of the product passage 11, for instance, as shown in FIGS. 1-3. This outlet 23 enables the aerosol product to be released in a desired spray pattern from the holder 1. The product outlet 23 also generally includes a nozzle 25 which may be molded directly into the holder 1 or which may also be a separate article which is inserted into the product outlet to provide a desired spray pattern and velocity to the ejected aerosol product as well as prevent overspray of the dispensed product.

The first sidewall opening 13 is essentially a notch intended to receive and support a rear portion of the trigger mechanism 17. It is generally sized and shaped to compliment the rear portion size and profile of the trigger mechanism 17. Notably smaller and situated on the opposite side of the wall from the second opening 15, this receiving opening 13 substantially defines a pivot point which permits biasing of the trigger mechanism 17 into supporting the spray can within the holder 1 and facilitating moving the trigger 17 into the actuating position and non-actuating positions as will be discussed in further detail below.

It is to be appreciated that these openings 13, 15 could be of any size or shape depending on, in particular, to correspond to the specific size and shape of the trigger mechanism 17.

Turning to FIGS. 4-7, the trigger mechanism 17 is now disclosed. The trigger mechanism 17 is provided with a finger actuated trigger portion 27 which extends upward and substantially perpendicular from a product support portion 31. A tab 33 extends below the product support portion 31 for assisting a user with the function of insertion and removal of the trigger mechanism 17 from the body of the holder 1 as well as moving the trigger 17 into both the engaged and disengaged positions.

Figure 5:
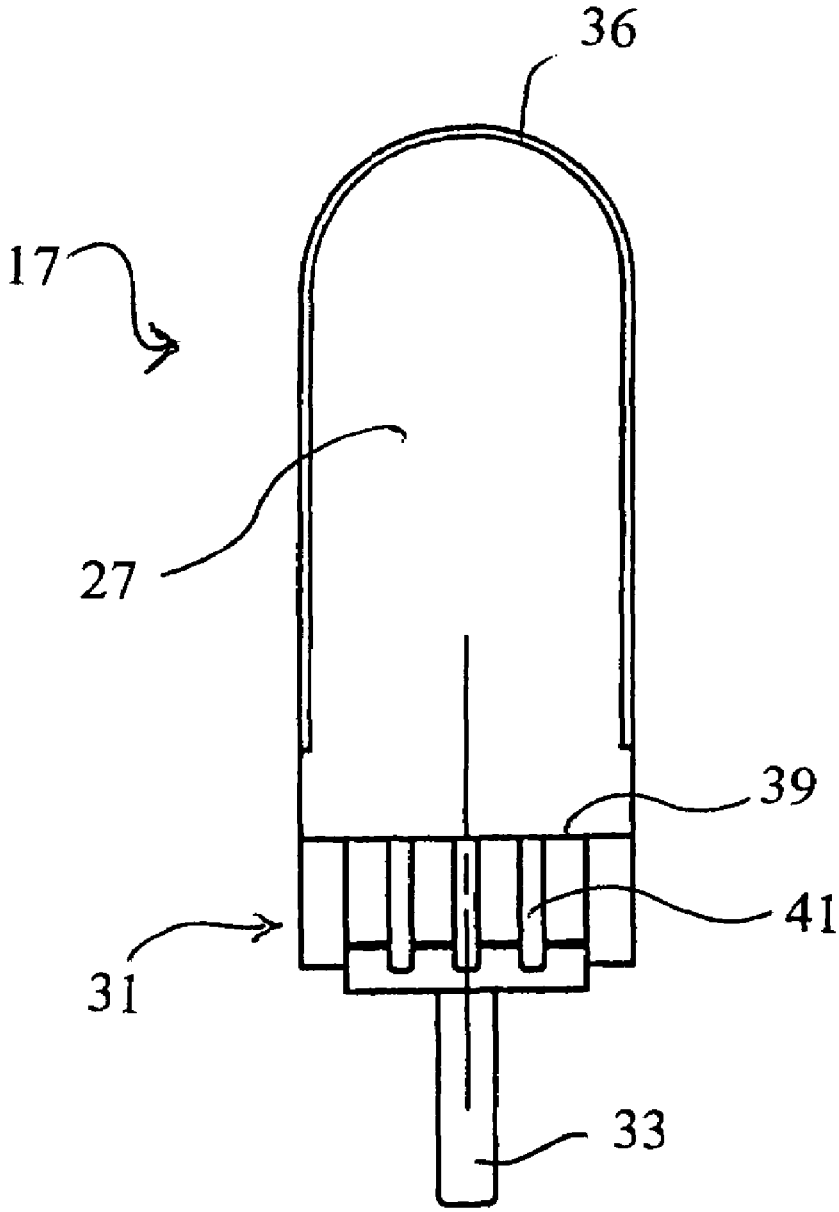
FIG. 5 is a rear view of the trigger mechanism of the aerosol can holder of the present invention.
Figure 6:
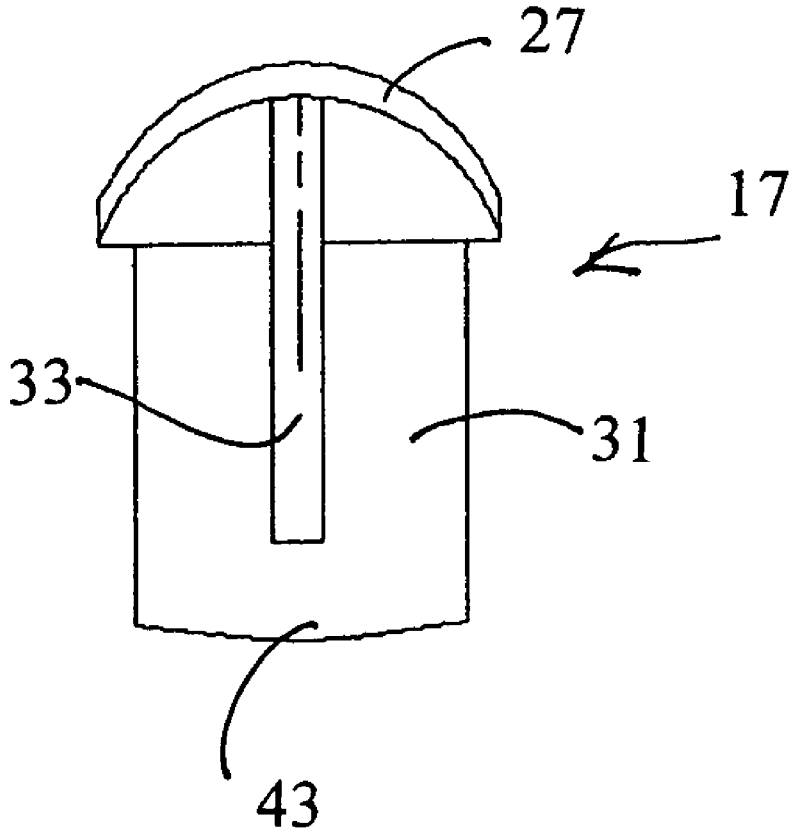
FIG. 6 is a bottom planar view of the trigger mechanism of the aerosol can holder of the present invention.
Figure 7:
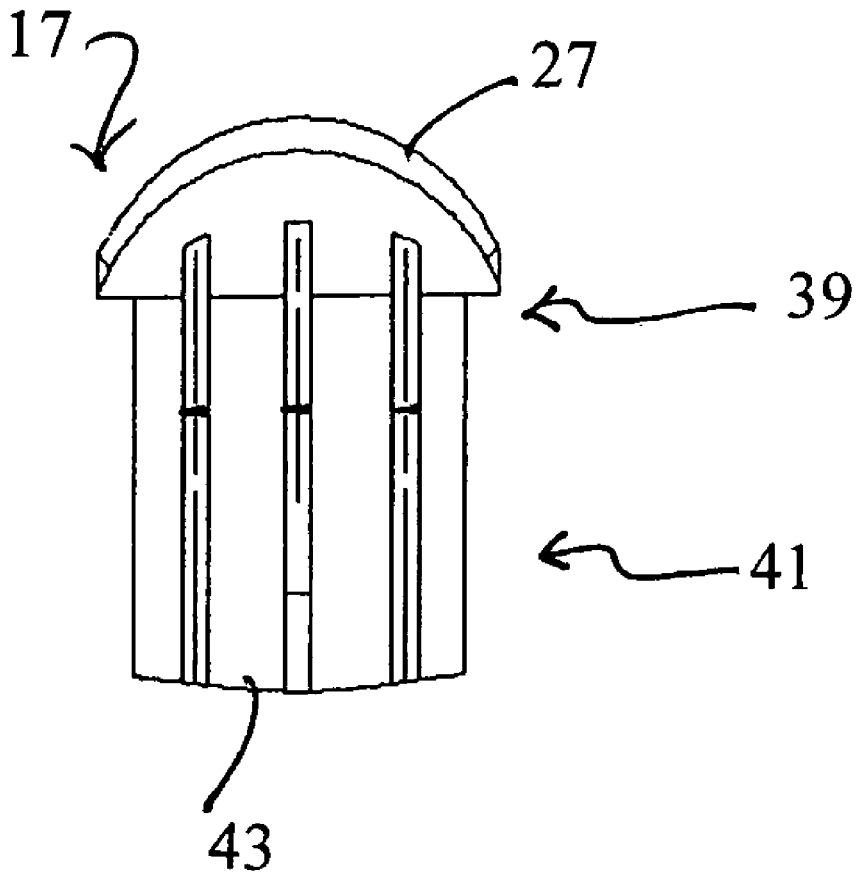
FIG. 7 is a top planar view of the trigger mechanism of the aerosol can holder of the present invention.

The trigger portion 27 extends from a connection with the product support portion 31 upwards to a free end 36 and has a profile as best seen in FIG. 5 which substantially conforms to the second sidewall opening 15 in the holder body 1. The trigger portion 27 is provided with an angled lip section 37 which is intended to frictionally engage the lowermost edge of the second sidewall opening 15 so as to assist in the biasing of the trigger mechanism 17 with respect to the aerosol can and facilitating the engaged and disengaged positions of the trigger 17.

The product support portion 31 is provided with a first aerosol can engaging surface 39 and a second angled aerosol can engaging surface 41. The angle may be between 5° and 40° degrees and more preferably 10° and 30° and most preferably about 20° relative to the first aerosol can engaging surface 41. It is to be appreciated that when the trigger mechanism 17 is in an inoperable state, i.e. disengaged, the trigger portion 27 is substantially flush with the sidewall 3 of the holder 1 as permitted by the similar profiles of the first sidewall opening 13 and the first surface 39 of the product support 31 engages the bottom of the aerosol can. Where the trigger mechanism 17 is moved to an actuating, or engaged position, the second angled surface 41 of the product support 31 rotates so as to engage the bottom of the aerosol can as the free end 36 of the trigger 27 is correspondingly rotated outwards relative to the sidewall of the holder 1 and thus extends outwardly from the sidewall 3 and sidewall opening 15 to define an extended lever for the user's fingers to pull and thus actuate the spray can.

Figure 8:
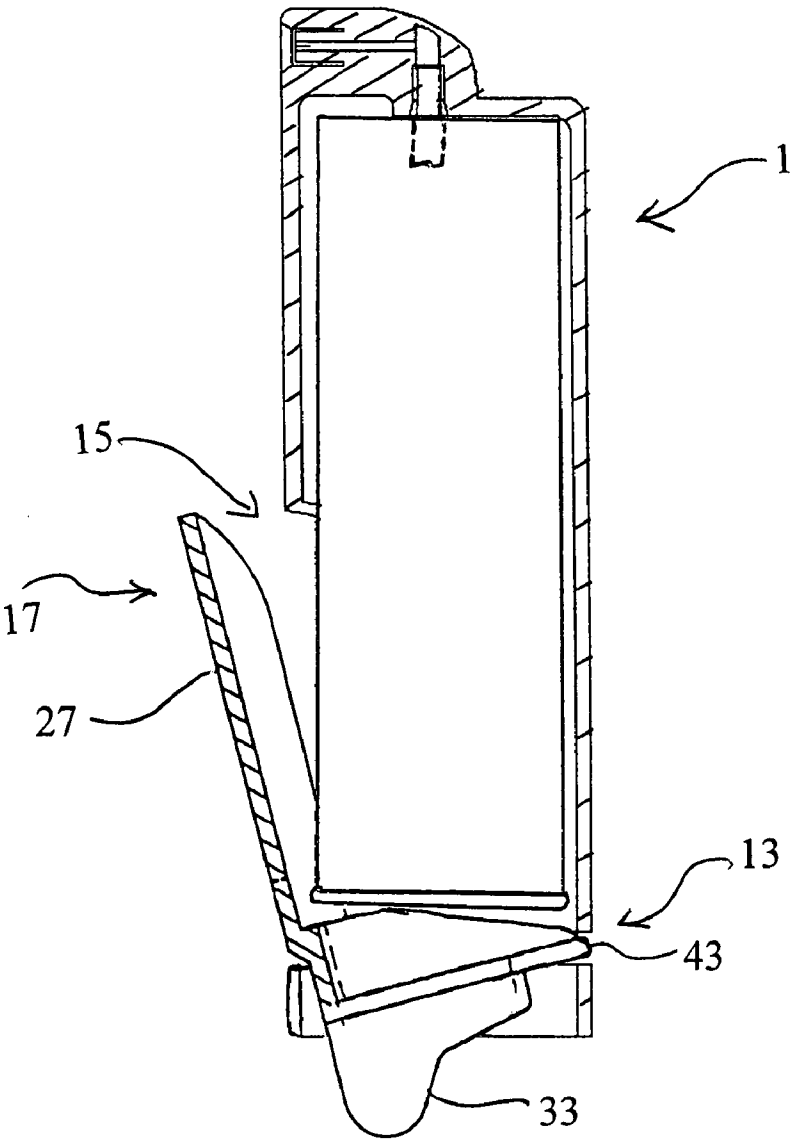
FIG. 8 is a side cross-sectional view of the device in an operative position.

The rear portion of the product support 31 is provided with an engagement section 43 which is intended to engage into the first sidewall opening 13 to provide the pivot about which the trigger mechanism 17 will rotate when in the operable position and operated by the user's fingers and pulled towards the holder 1. In the operating or engaged position the trigger mechanism 17 is angled outwardly from the holder 1 as shown in FIG. 8, the engagement section of the support 31 is held in the first opening 13 and the lip 37 is resting on the bottom edge of the second opening 15. The aerosol can receiving surface 41 is parallel engaged with the bottom of the aerosol can which because of the spring biased valve stem in the can maintains the trigger 17 in such an engaged position. To actuate the spray can, a user then squeezes the trigger towards the holder and when such movement occurs, the angled surface 41 slidably pushes up on the can, the valve stem of the can is thus forced against lip 21 and the spray can is actuated and its contents are dispersed as previously discussed.

Once the user is finished dispensing a desired amount of product, the user releases the trigger 17 and the inherent bias of the valve stem in the spray can then forces the spray can downwards relative to the lip 21 in the holder and the bottom of the spray can presses downwards along surface 41 causing the trigger 17 to rotate outwards about the pivot defined by opening 13 relative to the holder 1.

When the spray can is empty, the trigger mechanism 17 may be pulled downwards relative to the holder 1 and out the open bottom end 5 of the holder 1. The split in the sidewall adjacent the bottom end 5 of the holder 1 facilitates the removal, and re-insertion of the trigger 17 into the holder 1 by allowing the sidewall at the bottom end to widen slightly permitting the user to gently twist and tug the lip 37 past the lower edge of the second opening 15 and also to disengage the rear portion of the trigger mechanism 17 from the first opening 13 and thus withdrawal the respective portions of the trigger mechanism 17 from the first and second openings 13,15 and out the bottom end 5 of the holder 1.

Once this function is accomplished the empty aerosol can may be removed from within the holder, and a new one inserted in its place. The trigger mechanism 17 may then be reinserted through the bottom end 5 of the holder 1 and the rear portion re-engaged with the first opening 13 and the trigger portion 27 extended into the opening 15 where the split 16 again permits a slight widening of the sidewall 3 of the holder to facilitate passage of the lip 37 of the trigger mechanism over the lower edge of the second opening 15.

Figure 9:
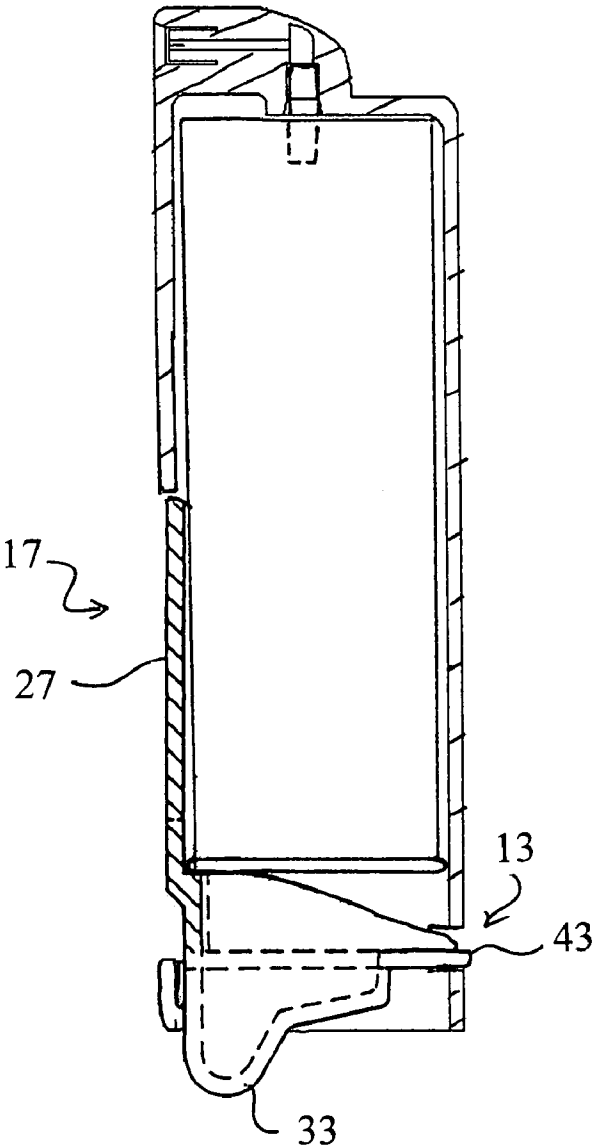
FIG. 9 is a side cross-sectional view of the device in an inoperative position.

The disengaged or inoperative position is provided by the trigger portion 27 being snapped or inserted directly into the opening 15 and substantially flush with the sidewall 3 of the holder 1. In this position the bottom of the aerosol can is directly engaged with the flat surface 39 of the support portion 31 of the trigger mechanism 17 as shown in FIG. 9. The downward bias of the can against the surface 39 maintains the trigger mechanism 17 in this disengaged or inoperative position with the trigger portion 27 flush with the holder 1.

It is to be appreciated that from the inoperative position as shown in FIG. 9, when a user desires to place the holder 1 in an operative state, the tab 33 is pulled substantially downward and rearward in such a manner so as to rotate the trigger portion 27 away from the sidewall of the holder 1 and slide the flat surface 39 out of contact with the bottom of the spray can and hence the angled surface portion 41 is relatively slid into direct contact with the bottom of the spray can. Also the lip 37 of the trigger 17 is brought into contact with the lower most edge of the opening 15 so as to further maintain the trigger 17 in the extended operative position.

Other embodiments of the present invention, shown generally in FIGS. 10-14, provide the aerosol can holder 1 with a differently shaped outer wall 3 from the substantially round barrel shaped previous embodiment and provides a more sleek elliptical outer shape. For example, in FIGS. 10 and 11, an elliptically shaped outer housing 3 is shown, in both side actuated and front trigger actuated embodiments, respectively.

Figure 10A:
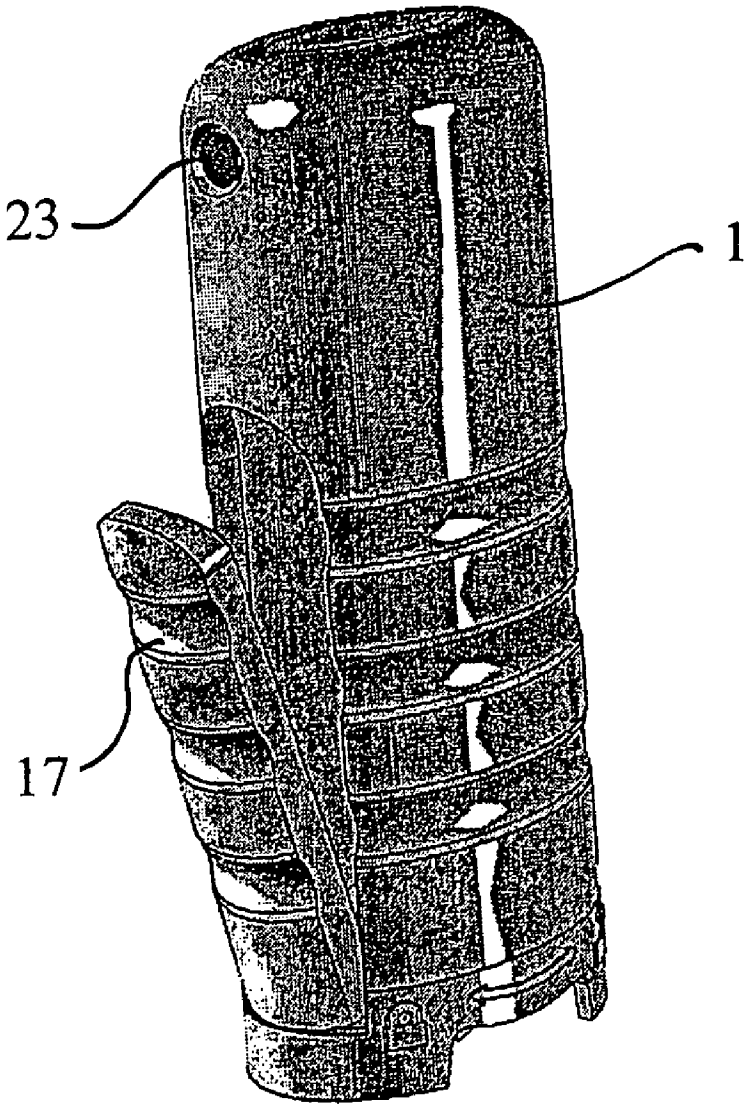
FIG. 10A is a general view of an embodiment having a side-actuated elliptical outer housing.
Figure 10B:
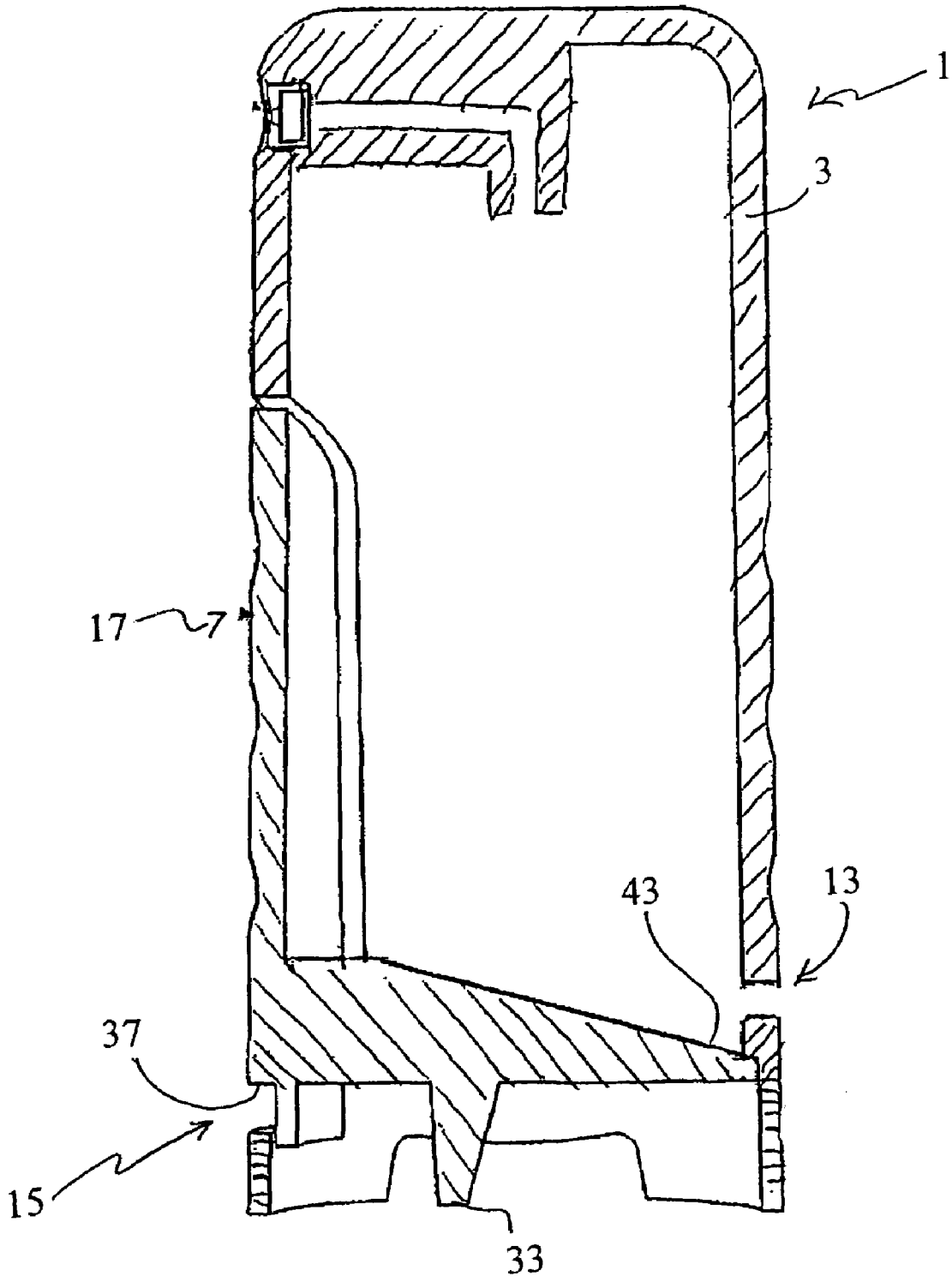
FIGS. 10B, C are cross-sections of the side actuated elliptical housing embodiment detailing the trigger mechanism and function.
Figure 10C:
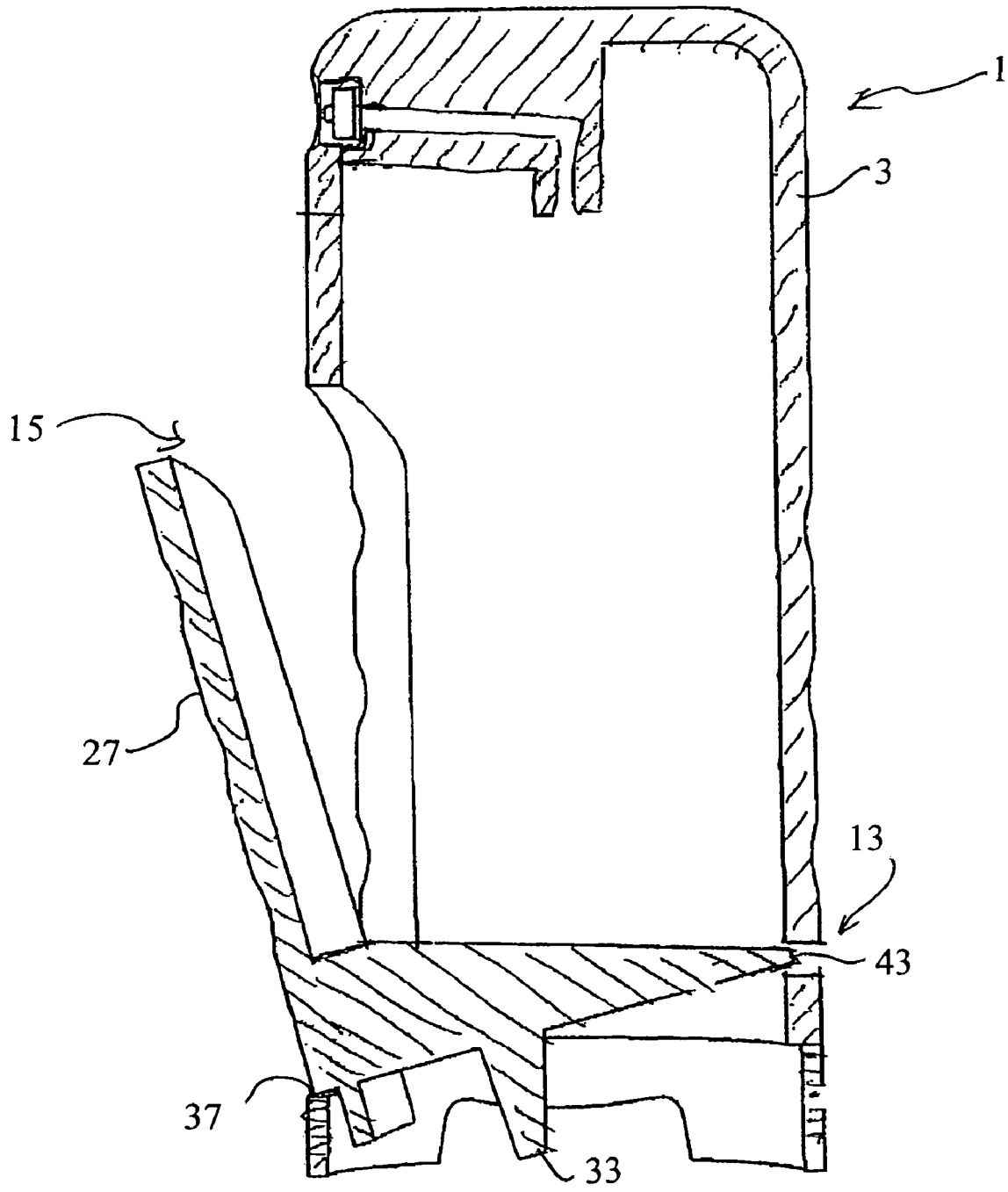
Figure 11:
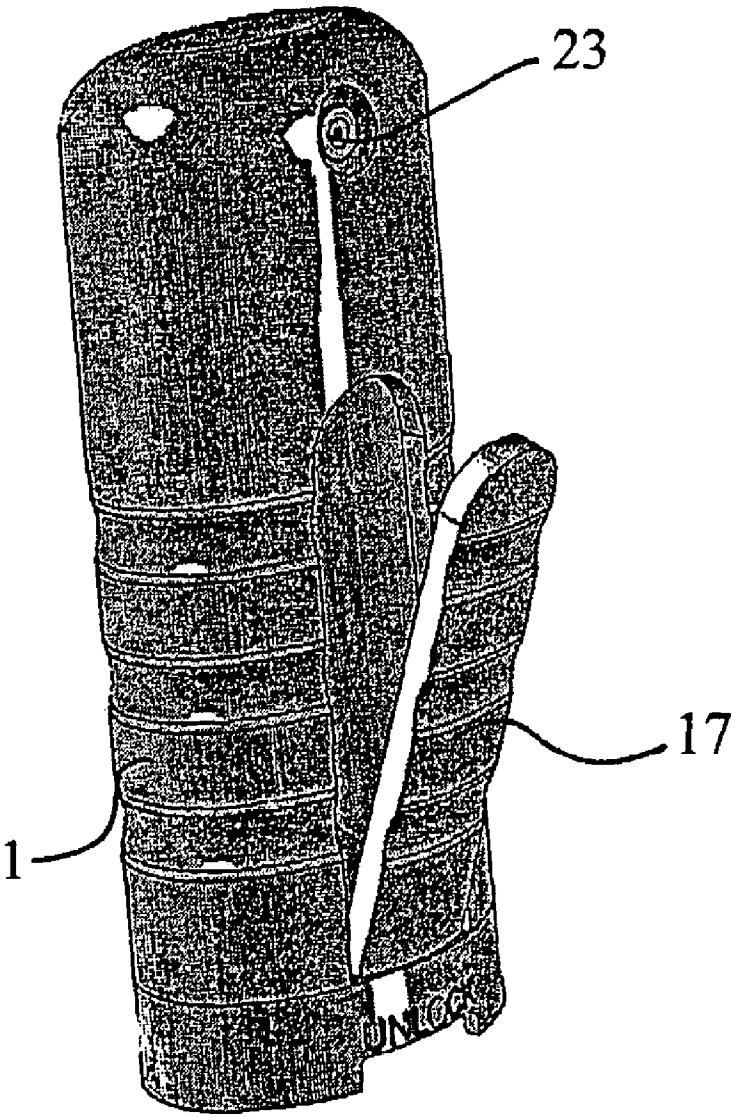
FIG. 11 is a general view of an embodiment having a front-actuated elliptical outer housing.

In both embodiments shown in FIGS. 10 and 11, the elliptical outer housing 45 contains a first and second openings 13,15 for receiving the trigger mechanism as discussed in relation to the first embodiment. All of the disclosed embodiments are characterized by the use of only the two main parts, the trigger mechanism 17 and the holder 1 for maintaining the spray can within the holder as well as actuating the spray can.

In FIGS. 10B, C a version of the trigger is shown which in the disengaged position in FIG. 10B, the end 43 of the trigger is at least partially out of engagement with the first opening 13, and in an engaged position the trigger is rotated so that end 43 of the trigger engages the opening 13 and the trigger portion 27 pivots away from the holder 1 and lip 37 is directly supported on the lower edge of the second opening 15. Also a notch N is provided in the bottom portion of the holder to facilitate access to the tab 33.

Figure 12:
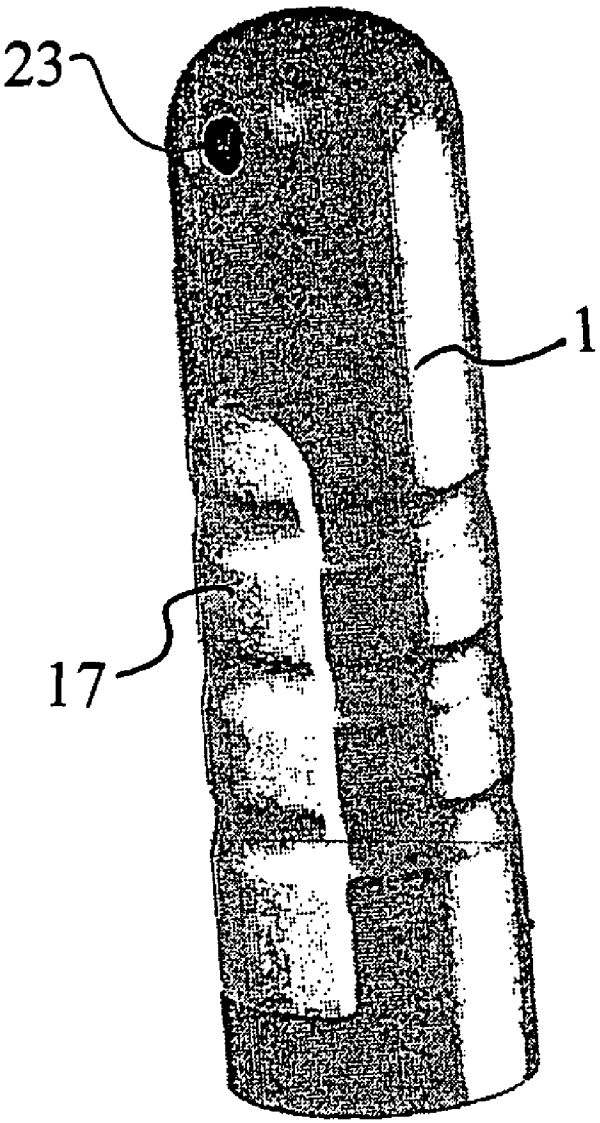
FIG. 12 is a general view of an embodiment having a round outer housing.
Figure 13:
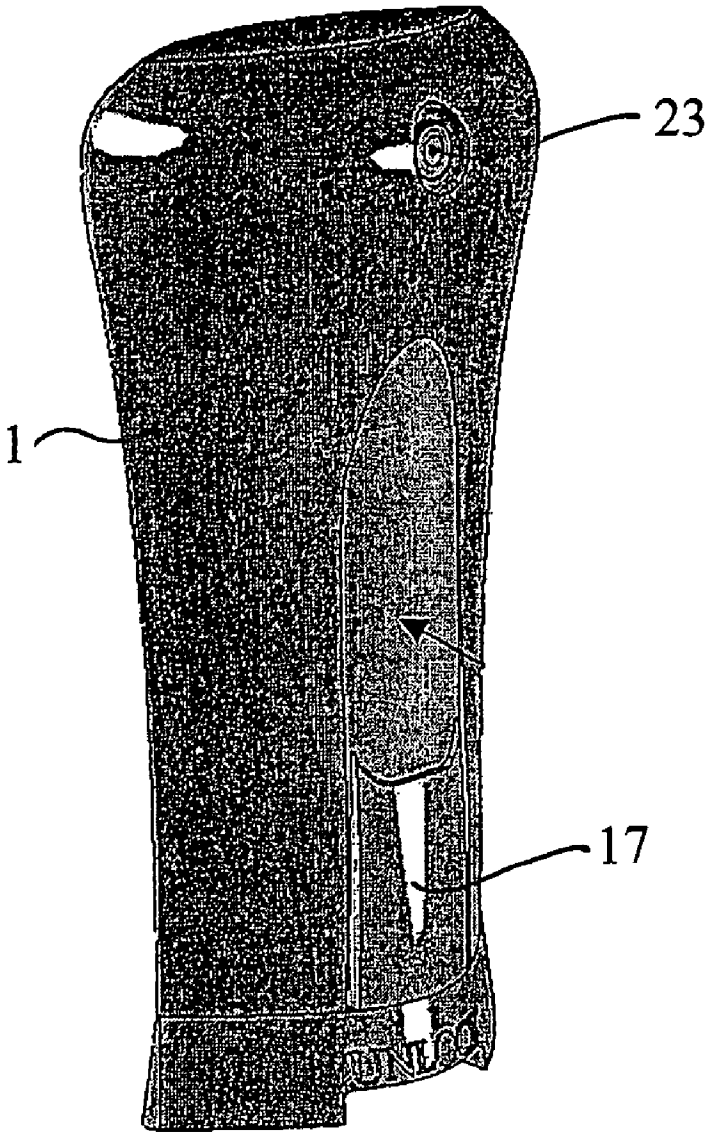
FIG. 13 is a general view of an embodiment having a flared outer housing.

FIGS. 12 and 13 generally disclose round and flared outer housings 45, respectively. The differences between these embodiments and the embodiments disclosed in FIGS. 10 and 11 lie generally in the shape and appearance of the outer housing 45, and are otherwise nearly functionally identical to the first described embodiment.

Figure 14:
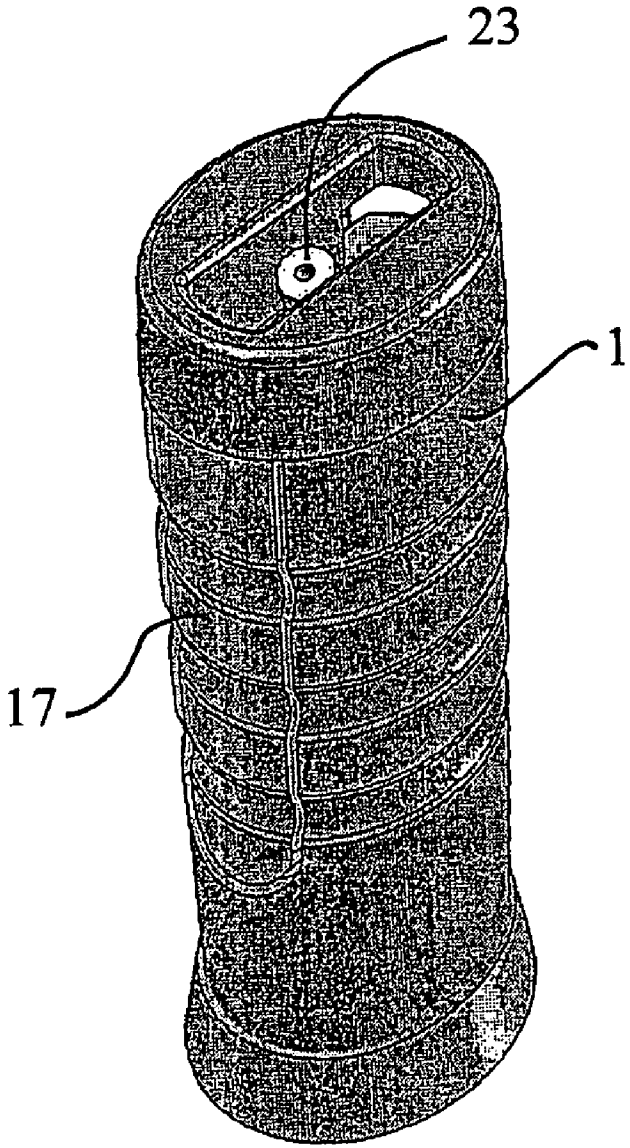
FIG. 14 is a general view of a vertical spray device having an elliptical housing and a top mounted trigger.

Yet another embodiment is shown in FIG. 14. This embodiment is unique from the other embodiments based on its vertical positioning of the product passage 11 and product outlet 23. Also different from the previous embodiments, the trigger mechanism 17 is positioned at the top of the holder as opposed to the bottom. Such a trigger mechanism would actuate a valve in a substantially similar manner to that as previously described, except that it would actuate the valve stem relative to the spray can from the top rather than the bottom of the holder.

Since certain changes may be made in the above described improvement, without departing from the spirit and scope of the invention herein involved, it is intended that all of the subject matter of the above description or shown in the accompanying drawings shall be interpreted merely as examples illustrating the inventive concept herein and shall not be construed as limiting the invention.

The invention claimed is:

1. An aerosol can holder comprising:

a holder body having a product receiving cavity defined by an outer wall having a generally open bottom end and a substantially closed top end;

a first opening and a second opening in the outer wall to pivotably facilitate a trigger mechanism;

a receiver having a collar located in a top portion of the holder for receiving a valve stem of an aerosol can;

a product passage extending from the receiver through the top portion of the holder, connecting with a product outlet which allows contents of an aerosol can in the product receiving cavity to be dispersed to the local environment;

a trigger mechanism abutting a bottom surface of an aerosol can and providing a compression force causing the valve stem of the aerosol can to engage the receiver of the top portion of the holder; and wherein the open bottom end is defined by a bottom edge and a split in the outer wall extends between the bottom edge of the holder body and an inner edge of one of the first and second openings, the split connecting the open bottom end and one of the first and second openings formed in the outer wall of the aerosol can holder to facilitate the engagement of the trigger mechanism with the first and second openings.

2. The aerosol can holder as recited in claim 1, wherein the trigger mechanism comprises a pivot point about which the trigger rotates for engagement in the first opening.

3. The aerosol can holder as recited in claim 2, wherein the trigger mechanism comprises an actuator which engages in the second opening and an intermediate contact portion located between the pivot point and the actuator which directly abuts the bottom of the aerosol can.

4. The aerosol can holder as recited in claim 3 further comprising a tab depending from the intermediate contact portion of the trigger mechanism for adjusting the position of the trigger mechanism relative to the aerosol can and the aerosol can holder.

5. The aerosol can holder as recited in claim 4 further comprising a first position wherein the actuator of the trigger mechanism extends through the second opening and a free end of the actuator is spaced from the outer wall.

6. The aerosol can holder as recited in claim 5 further comprising a second position wherein the actuator of the trigger mechanism substantially covers the second opening and the free end of the actuator is flush with the outer wall.

7. The aerosol can holder as recited in claim 6 wherein in the second position the pivot point of the trigger mechanism is disengaged with the first opening.

8. The aerosol can holder of claim 3, wherein the shape of the outer wall of the aerosol can holder is one of cylindrical and elliptical.

9. The aerosol can holder of claim 1, wherein the product outlet is directed substantially perpendicular to the direction of the valve stem of the aerosol can whereby the contents of the aerosol can are dispersed horizontally relative to the aerosol can holder.

10. The aerosol can holder of claim 1, wherein the product outlet is directed in substantially parallel with the valve stem of the aerosol can whereby the contents of the aerosol can are dispersed vertically relative to the aerosol can holder.

11. An aerosol can holder comprising:

a holder body having a product receiving cavity defined by an outer wall having a generally open bottom end communicating with the product receiving cavity and a substantially closed top end;

a first opening and a second opening in the outer wall communicating with the product receiving cavity to pivotably facilitate a trigger mechanism engaging the holder body adjacent the open bottom end;

a receiver having a collar located in a top portion of the holder for receiving a valve stem of an aerosol can;

a product passage extending from the receiver through the top portion of the holder, connecting the product receiving cavity with a product outlet which allows contents of an aerosol can to be dispersed to the local environment; and a split is formed in the outer wall of the holder, the split extending from a lower most edge of the body to an edge of one of the first and second openings so that the open bottom end, the split and one of the first and second openings is defined by a single contiguous edge.

12. The aerosol can holder as set forth in claim 11 further comprising a first position wherein a portion of the trigger mechanism extends into the second opening and a pivot portion of the trigger mechanism is directly supported in the first opening.

13. The aerosol can holder as set forth in claim 11 further comprising a second position wherein the trigger mechanism is disengaged from the first and second openings to permit receiving or ejecting an aerosol can from the holder body.

14. A method for using an aerosol can holder comprising the steps of:

forming a holder body by an outer wall having a generally open bottom end and a substantially closed top end;

pivotably facilitating a trigger mechanism in a first and second opening in the outer wall;

defining a receiver having a collar in a top portion of the holder for receiving a valve stem of an aerosol can;

extending a product passage from the receiver through the top portion of the holder, connecting with a product outlet which allows contents of an aerosol can to be dispersed to the local environment;

providing a compression force on a bottom surface of an aerosol can from the trigger mechanism, causing the valve stem of the aerosol can to engage the receiver of the top portion of the holder; and forming a split in the outer wall of the holder, the split extending from a lower most edge of the body to an edge of one of the first and second openings so that the open bottom end, the split and one of the first and second openings is defined by a single contiguous edge.

15. The method of using an aerosol container in claim 14, further comprising the step of inducing the compression force on the bottom side of the aerosol can by rotating the trigger mechanism in a substantially arcuate motion.

16. The method of using an aerosol container in claim 15 further comprising the step of defining an angle between about 5 degrees and about 40 degrees between the trigger mechanism and the outer wall of the holder body when pivotably facilitating the trigger mechanism in the first and second opening of the outer wall.

17. The method of using an aerosol container in claim 16, further comprising the step of defining an angle between about 10 degrees and about 30 degrees between the trigger mechanism and the outer wall of the holder body when pivotably facilitating the trigger mechanism in the first and second opening of the outer wall.

18. The method of using an aerosol container in claim 17, further comprising the step of removing the compression force from the aerosol container and pivoting the trigger mechanism until a trigger portion substantially covers the second sidewall opening.

* * * * *

UNITED STATES PATENT AND TRADEMARK OFFICE

CERTIFICATE OF CORRECTION

PATENT NO. : 7,614,526 B2
APPLICATION NO. : 11/488349
DATED : November 10, 2009
INVENTOR(S) : Walter Richard Gaillen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 648 days.

Signed and Sealed this

Nineteenth Day of October, 2010

David J. Kappos

David J. Kappos
*Director of the United States Patent and Trademark Office*